United States Patent [19]

Berry

[11] Patent Number: 4,793,534

[45] Date of Patent: Dec. 27, 1988

[54] MODULAR BACK PACK

[76] Inventor: Boyd B. Berry, 2006 Thompson Hwy., Richmond, Tex. 77469

[21] Appl. No.: 119,681

[22] Filed: Nov. 12, 1987

[51] Int. Cl.[4] ..... A45F 3/04; A45F 5/00; B65D 00/00; A41F 15/02

[52] U.S. Cl. ..... 224/209; 224/206; 224/223; 224/237; 224/252; 224/260; 224/264

[58] Field of Search ..... 224/149, 202, 206, 209, 224/211, 215, 216, 224, 237, 240, 252, 257, 259, 260, 264, 901, 203, 204, 182, 205, 207, 210, 212, 223, 227, 228, 229, 239, 250, 251, 258

[56] References Cited

U.S. PATENT DOCUMENTS

| | | | |
|---|---|---|---|
| 1,650,491 | 11/1927 | Calvert | 224/209 |
| 2,340,964 | 2/1944 | Kassner . | |
| 2,808,973 | 8/1954 | Gobble | 224/264 |
| 3,321,120 | 5/1967 | Cunningham . | |
| 3,739,961 | 6/1973 | Soukeras . | |
| 3,931,917 | 1/1976 | Zellmer . | |
| 3,938,716 | 2/1976 | Jackson et al. . | |
| 4,082,208 | 4/1978 | Lane, Jr. . | |
| 4,174,059 | 11/1979 | Maunder . | |
| 4,634,031 | 1/1987 | Frankhouse | 224/203 |

FOREIGN PATENT DOCUMENTS

| | | | |
|---|---|---|---|
| 1365328 | 3/1964 | France | 224/264 |

*Primary Examiner*—Henry J. Recla
*Assistant Examiner*—Robert Fetsuga
*Attorney, Agent, or Firm*—Gunn, Lee & Jackson

[57] ABSTRACT

A modular back pack is disclosed comprising four components which are detachably connected for use individually or in various combinations. The components of the back pack distribute the load about the hip area of the user to lower the user's center of gravity and thereby enhance his stability for hiking, climbing, or other outdoor activities.

18 Claims, 2 Drawing Sheets

FIG. 1
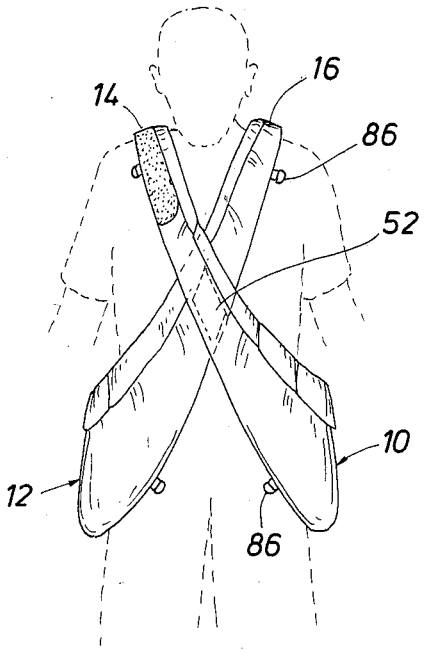
FIG. 2
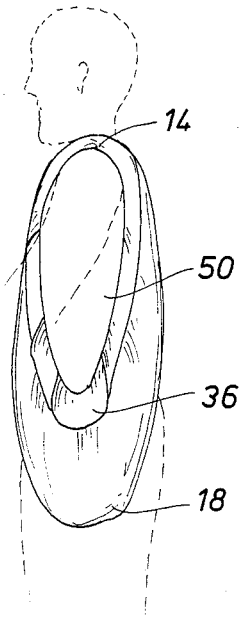
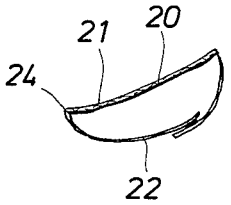
FIG. 4
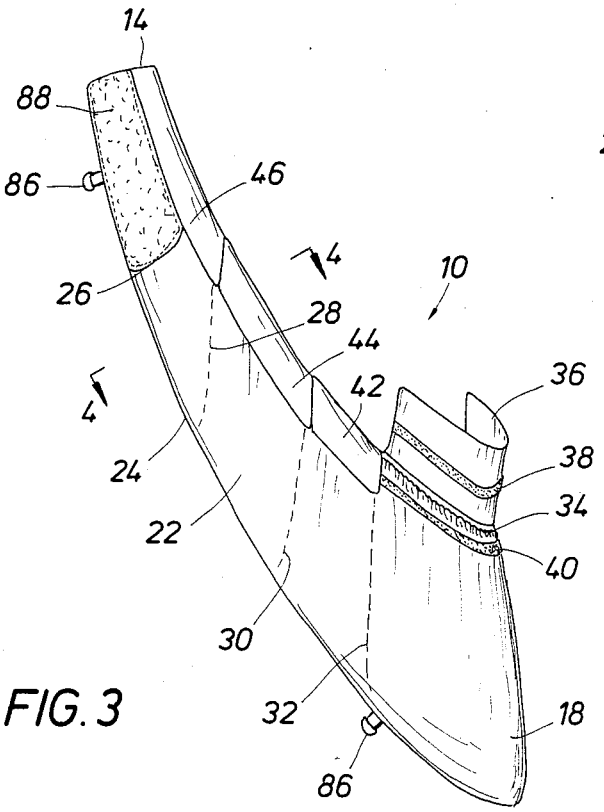
FIG. 3

MODULAR BACK PACK

BACKGROUND OF THE DISCLOSURE

The present invention is directed to back packs, particularly, an improved modular back pack which minimizes unbalancing of the load during use and lowers the center of gravity of the user, thereby providing more stability.

Various forms of back packs, nap sacks and carriers have heretofore been used by individuals to carry loads, particularly heavy loads, which are carried on the back and shoulders. Back packs are available in various sizes and shapes. Some back packs include rigid frames which facilitate the carrying of heavy loads. These back packs, however, have capacity limitations which may limit the distance that a hiker or overnight camper may venture from a base camp. In addition, the load in these back packs has a tendency to shift and become unbalanced over a period of time, making it much more difficult for the hiker to carry the load. It is, therefore, an object of the present invention to provide a modular back pack constructed in a manner which lowers the center of gravity of the hiker carrying a fully loaded back pack of the invention for enhancing the stability of the hiker for hiking, climbing and other strenuous type of activity.

It is another object of the present invention to provide a modular back pack including individual components which may be used by a hiker or overnight camper separately or in various combinations.

It is another obejct of the present invention to provide a modular back pack including individual components defining fabric enclosures partitioned to form a plurality of compartments which facilitate the packing of a balanced load enabling a hiker to carry heavier loads for longer distances.

SUMMARY OF THE DISCLOSURE

The invention of the present disclosure is directed to a modular back pack for carrying loads by a hiker or overnight camper. The modular back pack comprises four components. The components include a right and left shoulder loop which crisscross across the front and back of the hiker's torso. The shoulder loops are partitioned to form a plurality of compartments and include a large pouch on the lower ends thereof which rest over the hip area of the hiker. The front and back components are secured to the shoulder loops and provide additional packing capacity, particularly for carrying larger or bulky items. Each component is provided with overlying flaps to close the compartment openings.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are, therefore, not to be considered limiting of its scope, for the invention may admit to other equally effective embodiments.

FIG. 1 is a front view of the shoulder loop components of the invention about the torso of a hiker;

FIG. 2 is a side view of a shoulder loop component of the invention about the shoulder of a hiker showing the lower end of the shoulder loop resting on the hip area of the hiker;

FIG. 3 is a side, elevational view of the shoulder loop component of the invention showing the compartments therein and the overlying flap closure;

FIG. 4 is a sectional view of the shoulder loop component of the invention taken along line 4—4 of FIG. 3;

PREFERRED EMBODIMENT OF THE DISCLOSURE

Figure 5:
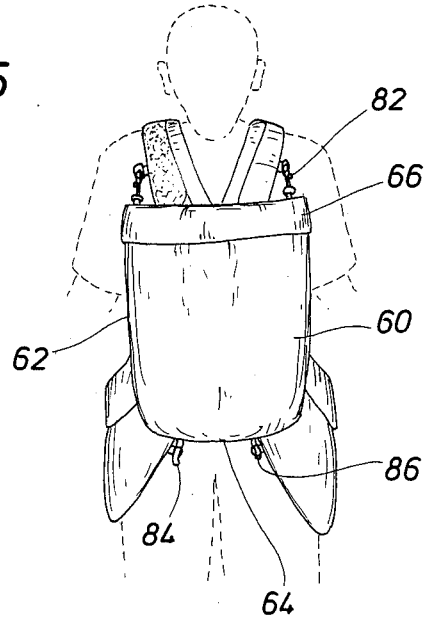
FIG. 5 is a front view showing the back pack components of the invention carried by a hiker.

Referring now to the drawings, the back pack of the invention comprises four separate components which may be used individually or in various combinations, depending on the needs of the hiker. In FIG. 1, the shoulder loop components 10 and 12 are pictorially shown being carried by a hiker or overnight camper. The shoulder loops 10 and 12 include shoulder portions or pads 14 and 16, respectively, which are carried on the shoulders of the hiker. The shoulder loops 10 and 12 extend diagonally across the body of the hiker and overlap to form a crisscross pattern across the chest and back of the hiker. The shoulder loop components 10 and 12 form a continuous loop which is narrow at the shoulder pads 14 and 16. The shoulder pads 14 and 16 are of sufficient width, typically in the range of 4" to 6", to comfortably carry the load of the back pack on the shoulders of the hiker. For comfortably carrying heavier loads, the shoulder pads 14 and 16 may be provided with extra padding. The shoulder pads 14 and 16 are sufficiently wide so that the load of the back pack is distributed across the shoulders of the hiker and do not dig into the shoulders of the hiker as may occur with relatively thin shoulder straps. The shoulder loop components 10 and 12 increase in width from the shoulder pads 14 and 16 to the enlarged portion 18 of the components 10 and 12 carried about the hip area of the hiker.

Referring now to FIG. 3, the shoulder loop component 10 is shown in greater detail. It is understood that the shoulder loop component 12 is substantially identical to the shoulder loop component 10 and therefore the shoulder loop component 12 will not be separately described. The shoulder loop component 10, as shown in FIGS. 2 and 3, is substantially oval in shape. It extends from the shoulder of a user to a pouch compartment 18 resting on the hip area of the user. The shoulder loop component 10 includes a resilient padding 20 encased within a fabric covering 21. The padding 20 forms the bottom or back side of the shoulder loop component 10 which contacts the body of the user. The padding 20 cushions the weight of the load carried in the back pack, particularly in the area of the shoulder pad 14. In addition, the padding 20 protects the user from sharp or pointed items which may be carried in the compartments of the shoulder loop component 10.

The outer fabric 22 of the shoulder loop component 10 is stitched along a forward edge 24 of the padding 20. Individual compartments are formed by stitching the outer fabric 22 to the fabric covering 21 of the padding 20 along stitch lines 26, 28, 30 and 32. A plurality of compartments may be formed as desired. The compartments may be tailored or sized for specific items, as for example, ammunition cartridges, canteen, or the like.

The individual compartments are closed along their open ends so that the items stored within the compartments do not inadvertently fall out. A variety of closures may be used to ensure that the access openings of the individual compartments are securely closed. In FIG. 3, the pouch compartment 18 is provided with elastic along its open end 34 which gathers the fabric 22 against the padding 20. A closure flap 36 is folded over the end 34 to close the pouch compartment 18. The flap 36 is provided with a Velcro strip 38 which engages and fastens with a Velcro strip 40 on the exterior of the pouch compartment 18 for fastening the flap 36 thereto. The flap 36 is slightly oversized so that it completely overlaps the opening 34 of the pouch compartment 18. In the event of rain, the oversized flap 36 prevents rain water from entering into the pouch compartment 18. Each of the individual compartments are provided with overlying flap closures. In FIG. 3, the overlying flap closures of the individual compartments are identified by the reference numerals 42, 44 and 46 which are substantially similar in appearance and function to the flap 36.

As set forth above, pouch compartment 18 is closed by an elastic member along the edge 34. An elastic closure for the pouch compartment 18 is particularly useful for its size and configuration. It will be observed that the pouch compartment 18 is substantially larger than the other individual compartments and defines a curved contour to fit about the hip area of the user. While elastic is a particularly suitable closure for the pouch compartment 18, other types of closures may also be used for the individual storage compartments and/or the pouch compartment 18. For example, Velcro, snaps, D-wing connectors, zippers, and the like may be used to close the access openings of the individual storage compartments.

Referring now to FIG. 2, it will be observed that the shoulder loop component is substantially oval in shape which circumscribes an opening 50. When putting the shoulder component on, the user places one arm and his head through the opening 50 so that the shoulder pad 14 rests on one of his shoulders and the shoulder loop component 10 extends across the chest area and back of the user to the hip opposite the shoulder on which the shoulder pad 14 is resting. The load of the shoulder loop component 10 is applied to the shoulder of the user and distributed across his body to the hip area. This reduces the center of gravity of the user so that the load is evenly distributed, particularly when both shoulder loop components are used as shown in FIG. 1 to enhance the stability of the user while hiking or climbing.

Referring again to FIG. 1, it will be observed that the shoulder loop components 10 and 12 crisscross across the chest of the user. The shoulder loop components 10 and 12 also crisscross across the back of the user in a similar fashion, although not shown in the drawings. While hiking or climbing, it is desirable to keep the shoulder pads 14 and 16 on the shoulders of the user. Generally, the weight of the load will tend to keep the shoulder loop components in proper position. Once the load in the shoulder loop components 10 and 12 has been balanced, it is undesirable for the shoulder loop components to shift relative to each other while the user is hiking and thereby unbalancing the load. To this end, Velcro fasteners are provided at the point of crossing 52 of the shoulder loop components 10 and 12 to fasten the components together and thereby prevent relative shifting of the components 10 and 12.

Figure 6:
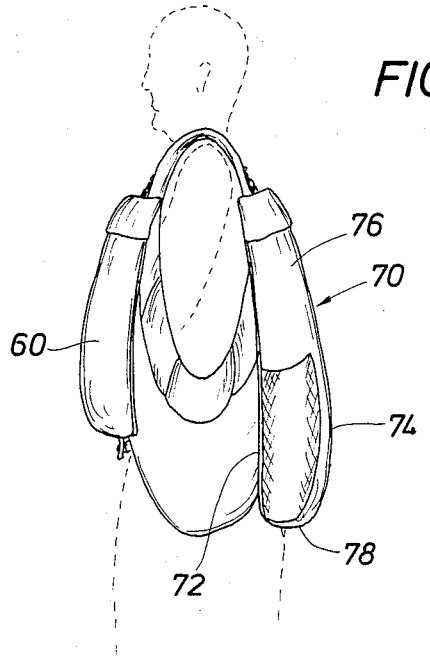
FIG. 6 is a side view showing the back pack components of the invention carried by a hiker.
Figure 7:
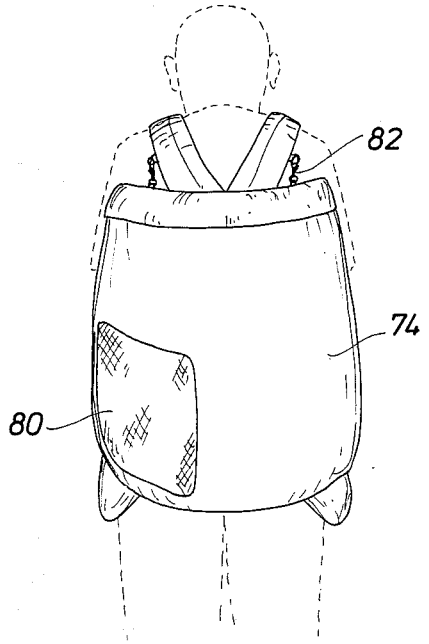
FIG. 7 is a rear view showing the back component of the back pack of the invention secured to the shoulder loop components.
Figure 8:
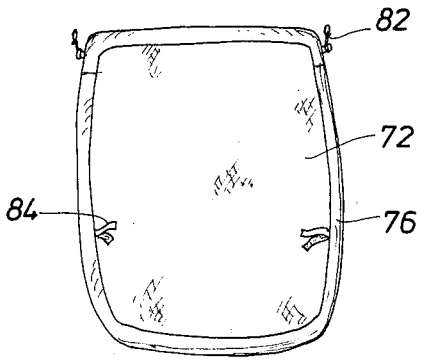
FIG. 8 is an elevational view of the back component of the back pack of the invention.

Referring now to FIGS. 5–8, the front and back components of the invention are shown fastened to the shoulder components 10 and 12. It will be observed that the front component 60 and back component 70 are substantially rectangular in shape forming a pouch-like enclosure. The front component 60 is formed by two pieces sewn together along the side edges 62 and bottom edge 64. The top of the front component 60 is closed by an overlapping flap 66 provided with a Velcro fastener or the like.

The back component 70 includes a rear member 72 and front member 74 connected by side members 76 and a bottom member 78. The back component 70 of the invention is larger than the front component 60 for carrying bulky items, for example, items which may be required for setting up a base camp. The back component 70 may also include an optional netting 80 sewed on the member 74 for storing wet clothing. The netting 80 may extend across the entire back of the back component 70, if desired. The front component 60 and back component 70 may also be provided with partitions to form internal compartments if desired.

When all components of the modular back pack of the invention are used by a hiker, the front and back components 60 and 70 are fastened to the shoulder loop components 10 and 12. D-ring fasteners 82 or the like are shown in the drawings for fastening the front and back components 60 and 70 to the shoulder loop components 10 and 12. Other types of fastening means, however, may be used. For ease in fastening and unfastening, the bottom of the front and back components 60 and 70 are fastened to the shoulder loop components by Velcro tabs 84 which fasten to D-ring buckles 86, as shown in FIGS. 1 and 3.

The modular back pack of the present invention is particularly useful for a number of purposes and extremely versatile. The weight distribution of the load provided by the back pack of the present disclosure permits the user to hike, climb and engage in outdoor activities with greater stability while carrying a substantial load. The modular feature of the invention permits a user to hike much greater distances. For example, all four components may be used to carry the requirements of a hiker to a base camp. The hiker may then continue to venture from the base camp for days at at time using one or both of the shoulder loop components to carry the provisions needed while away from the base camp.

The modular back pack of the present invention is particularly suitable for hunting or military applications. Fully loaded, the four components of the invention provide substantial body protection for the wearer. Ballistic cloth such as Kevlar, may be used to make the four components of the invention. Made out of Kevlar, the modular back pack of the invention would be virtually bullet-proof. A rifle butt pad 88 is provided on the shoulder loop component 12 so that a hunter may fire a rifle while carrying the shoulder loop components, even if they are fully loaded.

It will be understood that certain combinations and subcombinations are of utility and may be employed without reference to other features and subcombinations. This is contemplated by and is within the scope of the present invention.

As many possible embodiments may be made of this invention without departing from the spirit and scope thereof. It is to be understood that all matters hereinabove set forth or shown in the accompanying drawings are to be interpreted as illustrative and not in any limiting sense.

While the foregoing is directed to the preferred embodiment, the scope thereof is determined by the claims which follow.

What is claimed is:

1. A modular back pack comprising:

(a) a first shoulder loop component defining a first enclosure having a plurality of partitions for dividing the interior of said first enclosure to form a first set of compartments;

(b) a second shoulder loop component defining a second enclosure having a plurality of partitions for dividing the interior of said second enclosure to form a second set of compartments;

(c) a third component detachably connected to said first and second shoulder loop components across the chest of a user, said third component comprising a front pack having front and rear panels connected along three sides thereof to form said front pack enclosure; and (d) a fourth component detachably connected to said first and second shoulder loop components across the back of a user, said fourth component comprising a knapsack having front and rear members connected by side and end members to form said knapsack.

2. The apparatus of claim 1 wherein said first and second shoulder loop components have an oval configuration circumscribing an opening for receiving an arm and head of the user therethrough.

3. The apparatus of claim 2 wherein said first and second shoulder loop components include means for distributing the load carried by the user to lower the center of gravity of the user.

4. The apparatus of claim 2 wherein said first and second shoulder loop components crisscross across the body of the user, said first and second shoulder loop components including connector means located at the point of crossing cooperating to prevent relative shifting between said first and second shoulder loop components.

5. The apparatus of claim 1 wherein said first and second shoulder loop components include resilient padding encased in a fabric covering said resilient padding forming the bottom member of said first and second shoulder loop components.

6. The apparatus of claim 1 wherein said first and second shoulder loop components include a plurality of overlapping flaps along an edge thereof for closing over said first and second sets of compartments.

7. The apparatus of claim 4 wherein said overlapping flaps include fastener means for fastening said overlapping flaps in closing relationship over said first and second set of compartments.

8. The apparatus of claim 1 wherein said first and second shoulder loop components include a large compartment at the lower end thereof for transferring a substantial portion of the load about the hips of a user thereby distributing the load carried by the user to lower the center of gravity of the user.

9. The apparatus of claim 1 wherein said plurality of compartments are shaped and sized to receive specific goods.

10. The apparatus of claim 1 wherein said third and fourth components include partitions for dividing the interior thereof to form at least two compartments.

11. The apparatus of claim 1 wherein one of said first and second shoulder loop components includes a rifle butt pad fastened thereon.

12. The apparatus of claim 1 wherein said knapsack includes a net enclosure on the rear member for storing wet clothing.

13. The apparatus of claim 1 wherein said first and second shoulder loop components are substantially oval in shape circumscribing an opening for receiving an arm and a head of a user therethrough, said first and second shoulder loop components including shoulder pads for engaging the shoulders of the user and extending downwardly from said shoulder pads to a pouch compartment defined by the lower ends of said first and second shoulder loop components.

14. A modular backpack for carrying loads comprising at least two shoulder loop component defining an enclosure having a plurality of partitions for dividing the interior of said enclosure to form at least one storage compartment, said shoulder loop components crisscross each other across the body of a user, said shoulder loop components including fastener means located at the point of crossing for preventing relative shifting betwen said first and second shoulder loop components and further including a front storage component detachably connected to said shoulder loop components across the chest of the user, said front storage component including front and rear panels connected along three sides thereof to form a front storage enclosure provide with an access opening, said access opening being closed by overlapping flap means connected along said front storage enclosure access opening.

15. The apparatus of claim 14 including a knapsack detachably connected to said shoulder loop components, said knapsack including front and rear members connected by side and end members to form a knapsack having an access opening along an upper end thereof, said access opening being selectively closed by overlapping flap means connected along said knapsack access opening.

16. The apparatus of claim 17 wherein said shoulder loop components, said front storage component and said knapsack are formed of bulletproof material.

17. The apparatus of claim 17 wherein at least one of said shoulder loop components includes a rifle butt pad fastened thereon.

18. The apparatus of claim 17 wherein said storage compartments are shaped and sized to the configuration of specific goods.

* * * * *